US005600875A

United States Patent [19]

Chang

[11] Patent Number: 5,600,875

[45] Date of Patent: Feb. 11, 1997

[54] BUCKLE DEVICE FOR TIGHTENING STRAP

[76] Inventor: Chung-Hsin Chang, No. 68, Sec. 4, Mei Chuan East Road, Taichung, Taiwan

[21] Appl. No.: 523,268

[22] Filed: Sep. 5, 1995

[51] Int. Cl.[6] ..... A44B 11/06

[52] U.S. Cl. ..... 24/200; 24/163 R

[58] Field of Search ..... 24/163 R, 197, 24/198, 200, 305, 169

[56] References Cited

U.S. PATENT DOCUMENTS

| | | | |
|---|---|---|---|
| 3,579,745 | 5/1971 | Wilson | 24/307 |
| 4,400,855 | 8/1983 | Stuart | 24/200 |
| 5,088,161 | 2/1992 | Robertson | 24/305 |
| 5,426,829 | 6/1995 | Hsiung | 24/200 |

*Primary Examiner*—James R. Brittain
*Attorney, Agent, or Firm*—Charles E. Baxley, Esq.

[57] ABSTRACT

A buckle device for tightening a strap includes an opening formed in the middle portion for threading the strap. Two beams each includes two hooks engaged with the buckle device so as to be secured to the buckle device. The strap may be engaged through the buckle device and engaged with the beams before the beams are secured to the buckle device, such that the strap may be easily engaged through the buckle device.

1 Claim, 2 Drawing Sheets

BUCKLE DEVICE FOR TIGHTENING STRAP

BACKGROUND OF THE INVENTION

1. Field of the Invention

The present invention relates to a buckle, and more particularly to a buckle device for tightening a strap.

2. Description of the Prior Art

Typical buckles for tightening straps comprise a ring body having an extension radially extended inward therefrom for engaging with the straps to be tightened. The extension is solidly secured to the ring body and may not be disengaged from the ring body such that the strap may not be easily threaded through the ring body and engaged around the extension.

The present invention has arisen to mitigate and/or obviate the afore-described disadvantages of the conventional buckles.

SUMMARY OF THE INVENTION

The primary objective of the present invention is to provide a buckle device in which the strap may be easily threaded and engaged in the buckle device.

In accordance with one aspect of the invention, there is provided a buckle device for tightening a strap, the buckle device comprises a body including an opening formed therein for threading the strap, and at least one beam including hook means extended therefrom for engaging with the body so as to be secured to the body, the beam allowing the strap to be engaged thereon before the beam is secured to the body.

The body includes two ends each having a groove formed therein for engaging with the hook means so as to secure the beam to the body.

The buckle device includes two beams, the beams each includes a bottom surface having a plurality of ratchet teeth formed thereon, the body includes an upper surface having a plurality of ratchet teeth formed thereon for engaging with the ratchet teeth of the beams so as to prevent the beams from moving toward each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
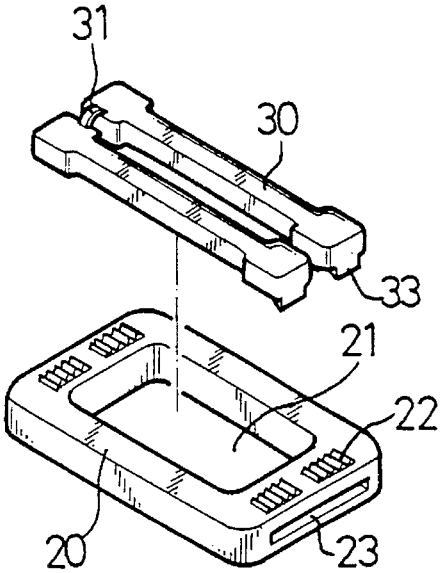
FIG. 2 is an exploded view of the buckle device.
Figure 1:
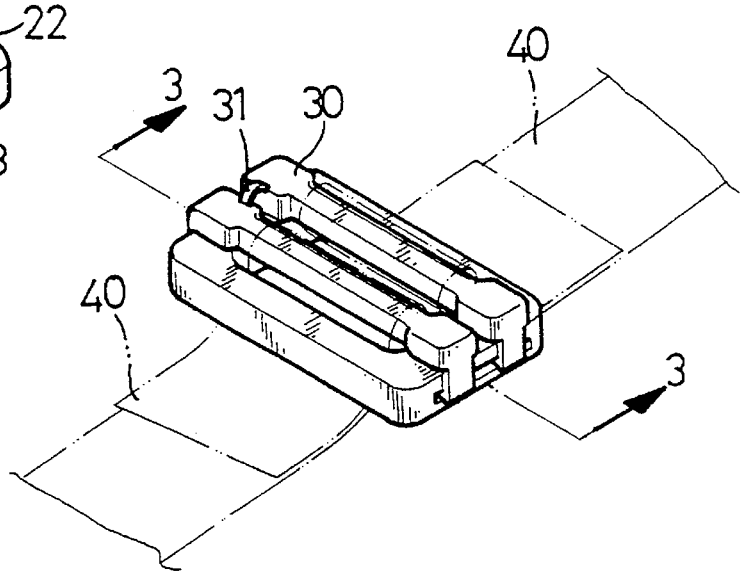
FIG. 1 is a perspective view of a buckle device in accordance with the present invention.
Figure 3:
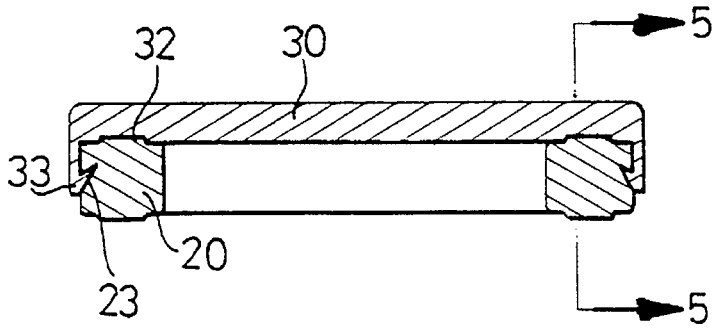
FIG. 3 is a cross sectional view taken along lines 3—3 of FIG. 1.

Referring to the drawings, and initially to FIGS. 1 to 3, a buckle device in accordance with the present invention comprises a body 20 including an opening 21 formed therein and including two end portions each having a groove 23 formed in the side portion and each having a number of ratchet teeth 22 formed in the upper surface thereof. Two beams 30 each includes two hook means 33 extended downward from the end portions for engaging with the grooves 23 so as to be secured to the body 20, and each includes a number of ratchet teeth 32 formed in the bottom portion for engaging with the ratchet teeth 22 of the body 20. It is preferable that the beams 30 have one end coupled together by a band 31 or the like. The strap 40 includes two ends engaged through the body 20 and engaged around the beams 30 respectively so as to be coupled together by the buckle device. It is to be noted that the strap 40 may be engaged through the opening 21 of the body 20 and engaged around the beams 30 before the beams 30 are secured onto the body 20, such that the strap 40 may be easily engaged with the buckle device.

Figure 5:
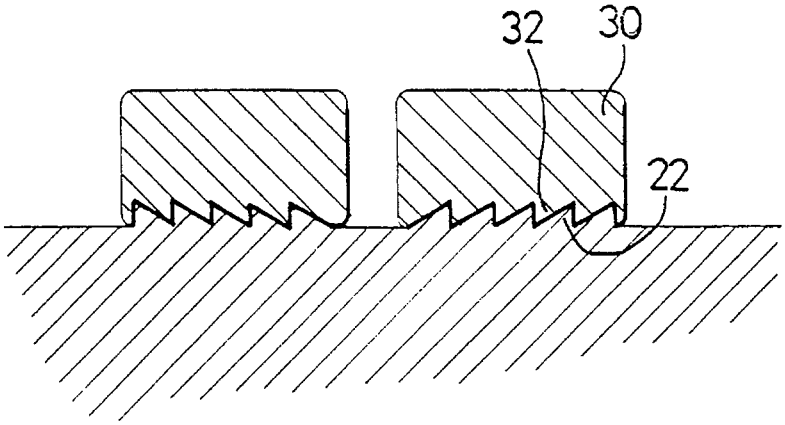
FIG. 5 is cross sectional view taken along lines 5—5 of FIG. 3.

Referring next to FIG. 5, the engagement between the ratchet teeth 22, 32 allows the beams 30 to move away from each other and prevents the beams 30 from moving toward each other.

Figure 4:
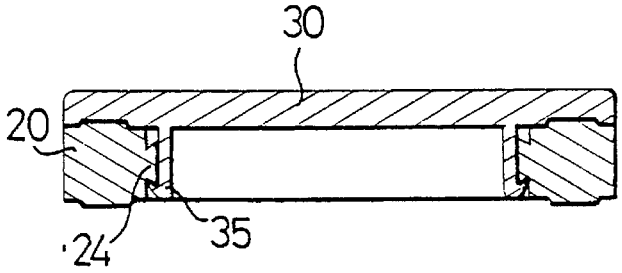
FIG. 4 is a cross sectional view similar to FIG. 3, illustrating the other application of the hook means of the buckle device.

Referring next to FIG. 4, alternatively, the beams 30 include hook means 35 extended inward of the opening 21 of the body 20 for engaging with the body 20 so as to be secured to the body 20.

Accordingly, the buckle device in accordance with the present invention includes a pair of beams that may be secured to the buckle body after the strap is engaged thereon such that the strap may be easily engaged with the buckle device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A buckle device for tightening a strap, said buckle device comprising:

a body including an opening formed therein for threading the strap;

two beams each including hook means extended therefrom for engaging with said body so as to be secured to said body, said beams allowing the strap to be engaged thereon before said beams are secured to said body;

wherein said beams each including a bottom surface having a plurality of ratchet teeth formed thereon, said body including an upper surface having a plurality of ratchet teeth formed thereon for engaging with said ratchet teeth of said beams so as to prevent said beams from moving toward each other.

* * * * *